US005256072A

United States Patent [19]

Hatagishi

[11] Patent Number: 5,256,072

[45] Date of Patent: Oct. 26, 1993

[54] CONNECTOR MOUNTING STRUCTURE

[75] Inventor: Yuji Hatagishi, Shizuoka, Japan

[73] Assignee: Yazaki Corporation, Tokyo, Japan

[21] Appl. No.: 982,609

[22] Filed: Nov. 27, 1992

[30] Foreign Application Priority Data

Nov. 27, 1991 [JP] Japan ..... 3-097429[U]

[51] Int. Cl.[5] ..... H01R 9/09; H01R 13/40

[52] U.S. Cl. ..... 439/79; 439/142; 439/372; 439/367; 439/521; 439/596; 439/892

[58] Field of Search ..... 439/79, 142, 367, 372, 439/377, 521, 596, 892, 893

[56] References Cited

U.S. PATENT DOCUMENTS

| | | | |
|---|---|---|---|
| 4,050,769 | 9/1977 | Ammon | 439/79 |
| 4,955,819 | 9/1990 | Harting et al. | 439/79 |
| 4,964,806 | 10/1990 | Sakamoto et al. | 439/79 |
| 4,986,772 | 1/1991 | Fukutani | 439/79 |
| 5,037,334 | 8/1991 | Viselli et al. | 439/79 |
| 5,114,335 | 5/1992 | Kimmel et al. | 439/79 |
| 5,174,776 | 12/1992 | Ohtaka et al. | 439/372 |
| 5,199,886 | 4/1993 | Patterson | 439/79 |

FOREIGN PATENT DOCUMENTS 59-126467 8/1984 Japan .

*Primary Examiner*—Paula A. Bradley

*Attorney, Agent, or Firm*—Sughrue, Mion, Zinn, Macpeak & Seas

[57] ABSTRACT

There is provided a structure for protecting lead terminals of a connector, which is disposed in a notch opening of a connector case, from dust and so on. In a connector mounting structure according to the present invention, a positioning plate for lead terminals of a connector is mounted on a rear of the connector, and the connector and the positioning plate are disposed in a notch opening in a case. A feature of this structure is that a cover wall for enclosing the lead wires 5 is formed integrally with the positioning plate through a hinge.

3 Claims, 3 Drawing Sheets

CONNECTOR MOUNTING STRUCTURE

BACKGROUND OF THE INVENTION

This invention relates to a structure for protecting lead terminals of a connector, which are disposed in a notch opening of a connector case, from dust and so on.

FIG. 4 is an exploded perspective view of a conventional connector mounting structure, and FIG. 5 is a vertical cross-sectional view of this structure.

In these Figures, a female connector 26 is mounted on a circuit board 29 provided within a notch opening 28 of a case 27, and a mating male connector for the female connector 26 is designated at 30.

The female connector 26 can fit the male connector 30 thereinto with a low operating force by a leverage obtained by a pivotal lever 31. Engagement bosses 32 are formed on an outer wall of the male connector 30, and horizontal guide grooves 34 are formed in opposite side walls of the female connector 26, respectively. Slanting engagement grooves 35 for the engagement bosses 32 are formed in the lever 31. When the lever 31 is pivotally moved in a direction of arrow a, the bosses 32 in sliding contact with the engagement grooves 35 and hence the male connector 10 are pulled in a connector fitting direction to achieve the fitting.

The notch opening 28 in the case 27 is provided for facilitating the mounting of the female connector 26, and also for avoiding the interference with the lever 31. As shown in FIG. 6, a positioning plate 38 of an insulating nature having insertion holes 37 for downwardly-directed lead terminals 36 is fixedly secured to the rear of the female connector 26. The lead terminals 36 are connected to the circuit board 29 by soldering. The positioning plate 38 is secured on the circuit board 29 by a securing means, such as a screw.

In the above conventional structure, however, dust, water droplets and so on intruding from the notch opening 28 of the case 27 deposit on the lead terminals 36, thereby producing rust and leakage, which has resulted in a problem that the electrical contact between the connectors 26 and 30 becomes imperfect.

SUMMARY OF THE INVENTION

With the above problem in view, it is an object of this invention to provide a connector mounting structure which can protect lead terminals from dust, water droplets and so on intruding from a notch opening of a case.

The above object has been achieved by a connector mounting structure wherein a positioning plate for lead terminals of a connector is mounted on a rear of the connector, and the connector and the positioning plate are disposed in a notch opening in a case, CHARACTERIZED in that a cover wall for enclosing the lead terminals is formed integrally with the positioning plate through a hinge.

The cover wall, formed integrally with the positioning plate for the lead terminals, prevents dust and water droplets from adhering to the lead terminals, thereby maintaining a good electrical contact.

DESCRIPTION OF THE PREFERRED EMBODIMENT

Figure 1:
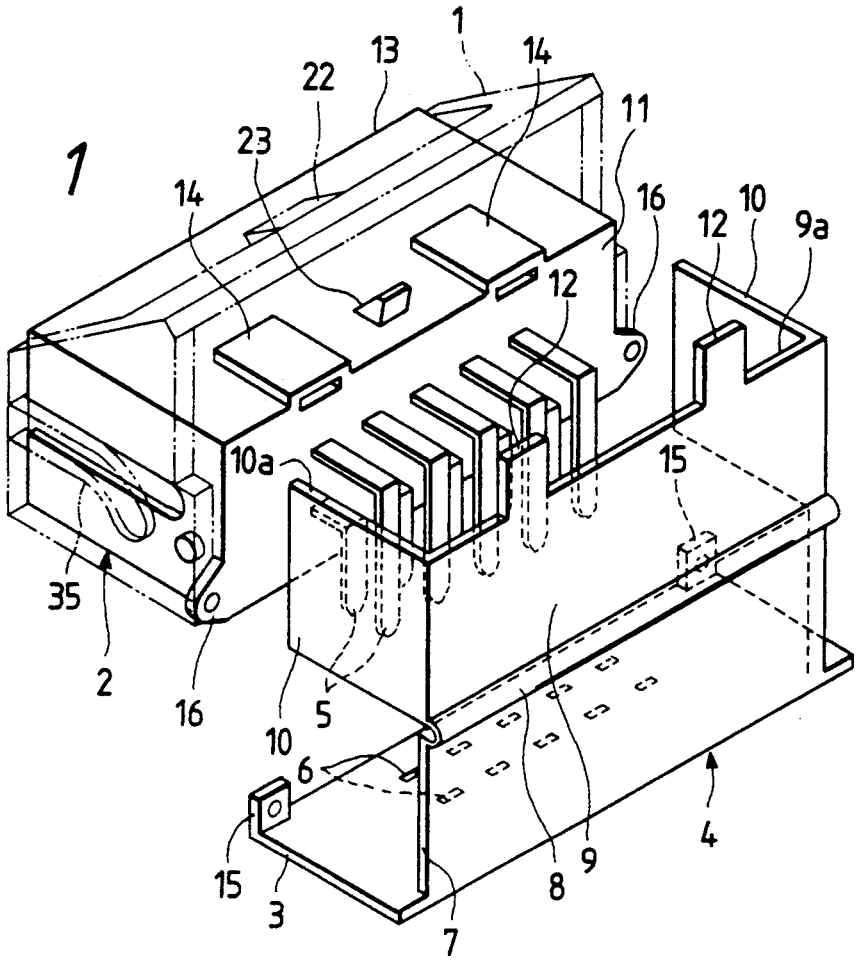
FIG. 1 is an exploded, perspective view of a preferred embodiment of a connector mounting structure of the present invention.
Figure 2:
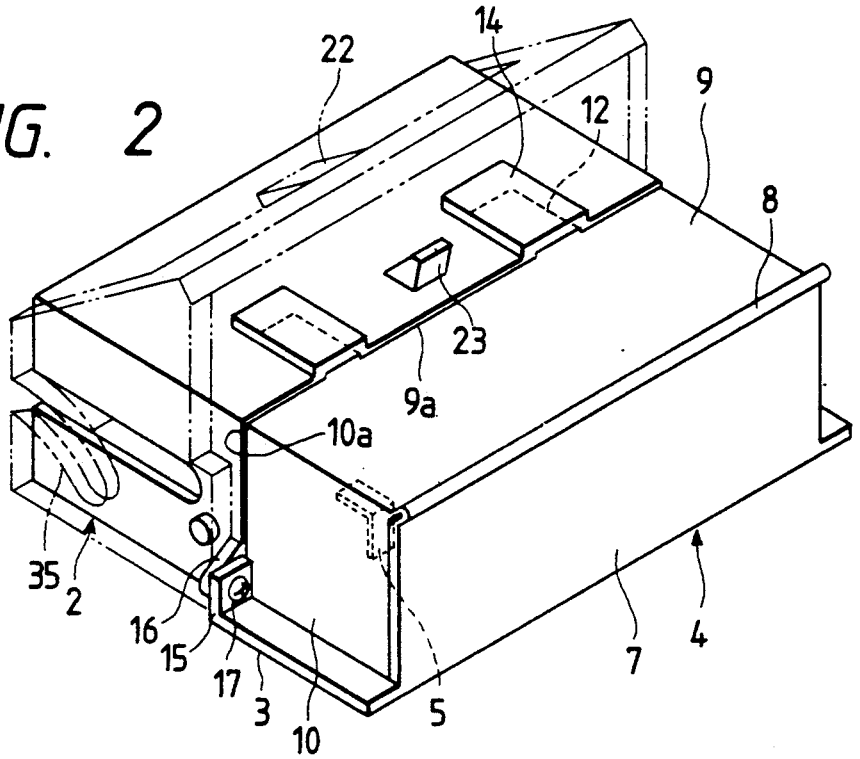
FIG. 2 is a perspective view of the above structure in an assembled condition.
Figure 3:
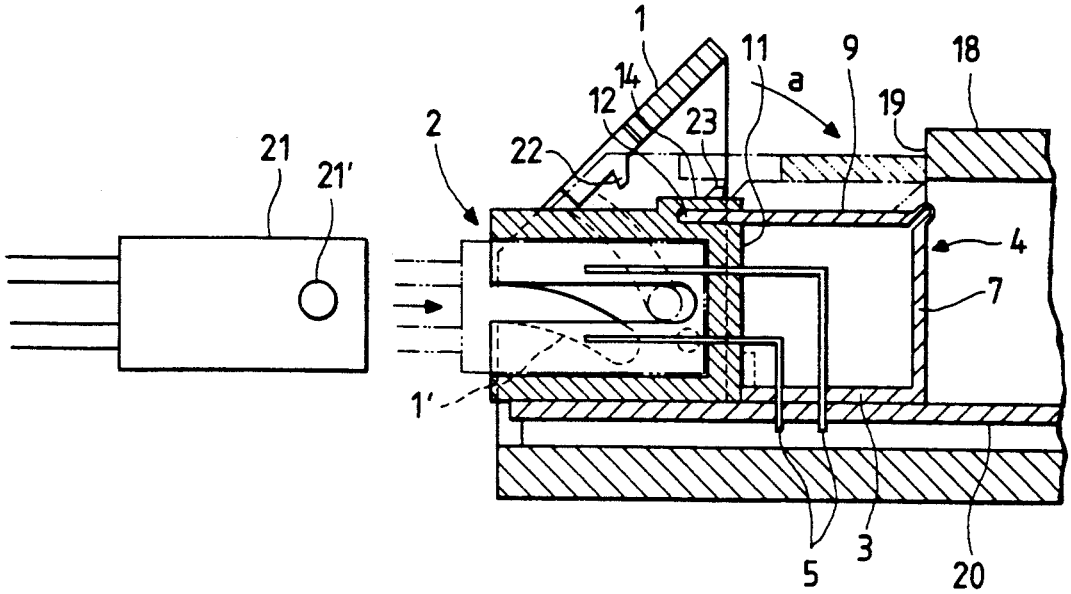
FIG. 3 is a vertical cross-sectional view of the above structure mounted in a notch opening of a case.
Figure 4:
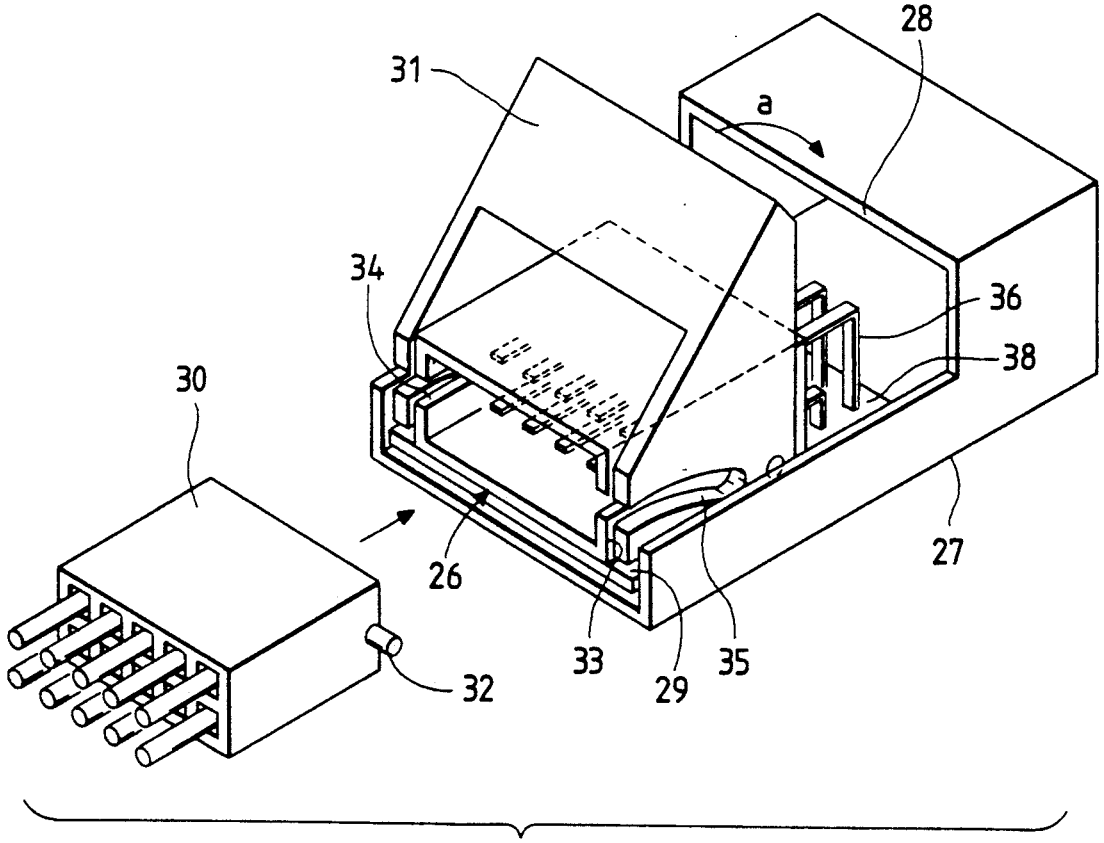
PRIOR ART FIG. 4
FIG. 4 is an exploded perspective view of a conventional example.
Figure 5:
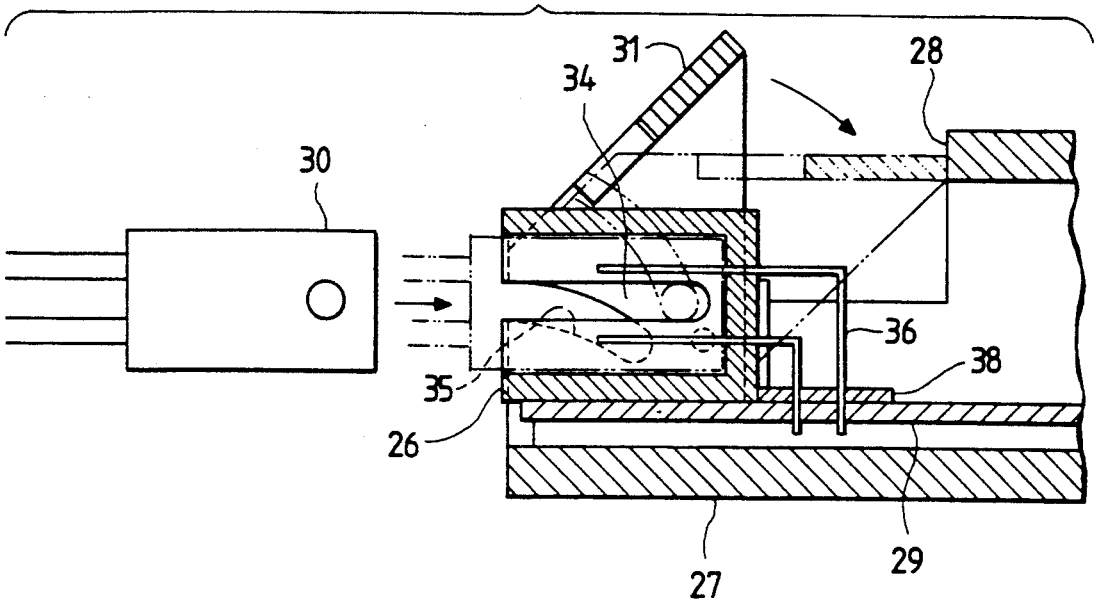
PRIOR ART FIG. 5
FIG. 5 is a vertical cross-sectional view of the above conventional example.
Figure 6:
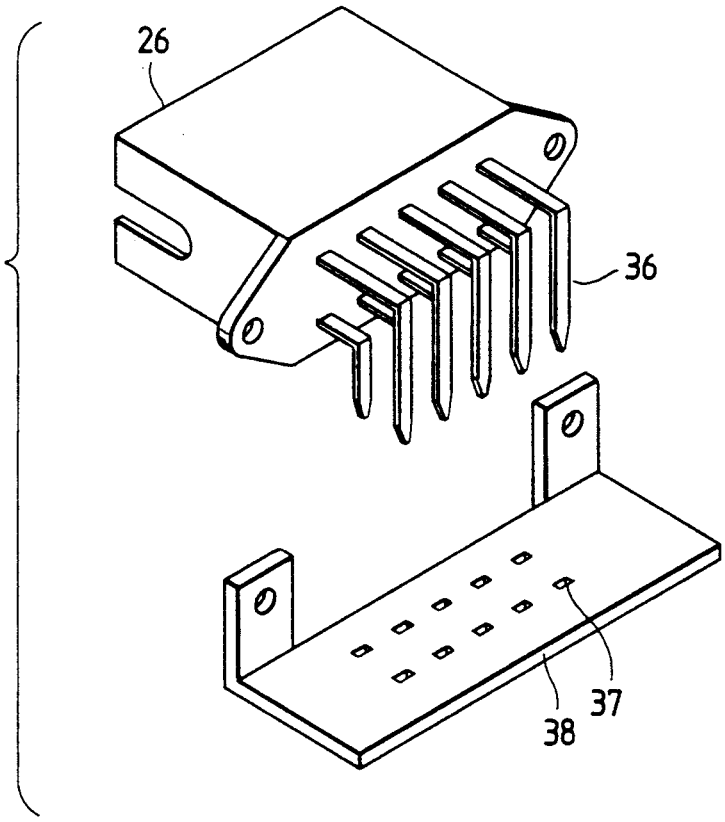
PRIOR ART FIG. 6
FIG. 6 is an exploded perspective view showing a positioning plate for lead terminals of the above conventional connector.

FIG. 1 is an exploded perspective view of a preferred embodiment of a connector mounting structure of the present invention, and FIG. 2 is a perspective view of this structure in an assembled condition, and FIG. 3 is a vertical crosssectional view of this structure mounted in a case.

A feature of this structure is that a cover wall 4 is formed integrally with a terminal positioning plate 3 of an insulating nature mounted on a rear of a female connector 2 having a pivotal lever 1 similar to a conventional lever.

The cover wall 4 comprises a rear wall 7 extending upright from the rear end of the positioning plate 3 having insertion holes 6 for lead terminals 5 of the female connector 2, an upper wall 9 integrally formed on the rear wall 7 through a thinned hinge portion 8, and side walls 10 and 10 formed respectively on opposite sides of the upper wall 9. The walls 9 and 10 are bent inwardly to surround the lead terminals 5 together with a rear wall 11 of the female connector 2.

A pair of retaining pieces 12 and 12 are formed on and projected from the cover upper wall 9. The retaining pieces 12 and 12 are fitted respectively in insertion portions 14 and 14 formed on a top wall 13 of the female connector 2, and a pair of fixing pieces 15 and 15 formed upright on the front end of the positioning plate 3 are fixedly secured by a screw 17 to flanges 16 and 16 of the connector rear wall 11, respectively, thereby holding front ends 9*a* and 10*a* of the upper wall 9 and side walls 10 in intimate contact with the connector rear wall 11. By doing so, the lead terminals 5 of the female connector 2 are completely protected against the intrusion of dust and water droplets from the exterior.

As shown in FIG. 3, the female connector 2 and the positioning plate 3 formed with the cover wall 4 are mounted on a circuit board 20 within a notch opening 19 in a case 18 of a synthetic resin through a securing means, such as a screw.

Then, bosses 21' of a mating male connector are brought in sliding contact with slanting engagement grooves 1' of the lever 1, and the pivotal lever 1 of the female connector 2 is operated 2 into the female connector 2. The pivotally-moved lever 1 is disposed above the cover wall 4 disposed within the notch opening 19, with a retaining pawl 22 thereof engaged with a retaining projection 23 of the female connector 2. Even if dust or the like enters the notch opening 19 during the use, the lead terminals 5 of the female connector 5 are protected by the cover wall 4, thereby maintaining a good electrical contact condition.

As described above, in the present invention, the cover wall is integrally formed utilizing the terminal positioning plate, so that the lead terminals of the connector can be protected from dust, water droplets and so on intruding from the notch opening of the case, and besides any labor and cost for attaching an additional cover are not needed, which is economical.

While the present invention has been described above with respect to preferred embodiments thereof, it should of course be understood that the present invention should not be limited only to these embodiments but various changes or modifications may be made without departure from the scope of the invention as defined by the appended claims.

What is claimed is:

1. A connector mounting structure comprising:

a positioning plate mounted on a rear of a connector for positioning lead terminals of the connector, said connector and said positioning plate being disposed in a notched opening in a connector case; and a cover means formed integrally with the positioning plate through a hinge member for enclosing the lead wires.

2. A connector mounting structure according to claim 1, in which said connector has a first engaging member and said cover means has a second engaging member which is fittingly coupled with said first engaging member of said connector.

3. A connector mounting structure according to claim 2, in which said first engaging member of said connector is a pair of insertion portions, and said second engaging member of said cover means is a pair of retaining pieces which are fitted in said insertion portions respectively.

* * * * *